US005967904A

United States Patent [19]

Nagai et al.

[11] Patent Number: 5,967,904

[45] **Date of Patent: *Oct. 19, 1999**

[54] GOLF CLUB HEAD

[76] Inventors: Yoshitaka Nagai, 1069-2 Tsukiyama, Asahi-machi, Shimoniikawa-gun, Toyama; Katsumasa Ohtera, 203-7 Inuyama, Kurobe-shi, Toyama; Masaki Sato, 2-11-7 Shintakane, Funabashi-shi, Chiba, all of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,946

[22] Filed: Nov. 15, 1996

[30] Foreign Application Priority Data

Nov. 17, 1995 [JP] Japan ..... 7-300245

[51] Int. Cl.[6] ..... A63B 53/04

[52] U.S. Cl. ..... 473/345; 473/349

[58] Field of Search ..... 473/324, 329, 473/345, 346, 349, 350

[56] References Cited

U.S. PATENT DOCUMENTS 5,074,935 12/1991 Masumoto et al. .

FOREIGN PATENT DOCUMENTS 4-367678 12/1992 Japan .

*Primary Examiner*—Sebastiano Passaniti

*Attorney, Agent, or Firm*—Finnegan, Henderson, Farabow, Garrett & Dunner, L.L.P.

[57] ABSTRACT

A golf club head made of a hollow metal comprising a face and a body, wherein at least the face is made of a rapidly solidified Al-based alloy having a high strength, high elasticity and light weight. This golf club head makes it possible to stroke a ball without elastic deformation of its face and also to fly the ball farther with the initial speed thereof maintained, by using the Al-based alloy at least in the face. In addition, the use of the Al-based alloy makes it possible to form a large head and a long shaft so that balls can be stroked to fly over a long carry in an accurate direction.

8 Claims, 3 Drawing Sheets

GOLF CLUB HEAD

BACKGROUND OF THE INVENTION

1. Field of the Invention

The present invention relates to a golf club head made of a hollow metal, which is formed of a plastic metal, particularly, a high-strength Al-based alloy manufactured by a rapid solidifying method, or the like.

2. Description of the Prior Art

In recent years, golf clubs, such as drivers having a metal or alloy head, called a metal wood, have been developed, so that balls can be stroked to fly over a long carry in a more accurate direction by an easy stroking technique. In addition, it has been proposed to provide various kinds of metal woods having a head made of titanium or a titanium alloy which has light weight and is superior in force of repulsion and corrosion resistance to other metals or alloys. Japanese Patent Laid-Open No. 4-367678 discloses a golf club head made of titanium and a titanium alloy. Another proposal using duralumin has been also made.

Strong and light materials have been desired as materials for golf club heads, and stainless steel, titanium, titanium alloy and duralumin have heretofore been used. However, although stronger and lighter heads capable of providing far longer carry are desired, there has not yet been a material which can fully satisfy such a demand.

SUMMARY OF THE INVENTION

The present invention is, therefore, intended to provide a golf club head which is formed of a light and strong metal material and which can realize a large head and a long shaft so that the moment of inertia required to fly a ball farther can be made large.

The present invention provides a golf club head made of a hollow metal and comprising a face and a body, wherein at least the face is made of a rapidly solidified Al-based alloy.

The rapidly solidified Al-based alloy used in the present invention has a composition represented by one of the following general formulae (I) to (IV).

$$Al_aM_{1b}X_e \quad (I)$$

$$Al_aM_{1(b-c)}M_{2c}X_e \quad (II)$$

$$Al_aM_{1(b-d)}M_{3d}X_e \quad (III)$$

$$Al_aM_{1(b-c-d)}M_{2c}M_{3d}X_e \quad (IV)$$

(wherein $M_1$: at least one element selected from the group consisting of Mn, Fe, Co, Ni and Mo; $M_2$: at least one element selected from the group consisting of V, Cr and W; $M_3$: at least one element selected from the group consisting of Li, Ca, Mg, Si, Cu and Zn; X: at least one element selected from the group consisting of Nb, Hf, Ta, Y, Zr, Ti, Ag, rare-earth elements and a composite (Mm: misch metal) of rare-earth elements; and a, b, c, d and e lie in the following ranges, in atomic percentages: $75 \leqq a \leqq 97$, $0.5 \leqq b \leqq 15$, $0.1 \leqq c \leqq 5$, $0.5 \leqq d \leqq 5$, and $0.5 \leqq e \leqq 10$.)

The present inventors have attempted to develop a series of the above-described superplastic Al alloys. Specifically, the present inventors have proposed materials suited to superplastic working by attaining an amorphous phase, a mixture phase of an amorphous phase and a microcrystalline phase, or a microcrystalline phase by quenching an alloy material having one of the aforesaid specific compositions.

Such alloys have drawn attentions as alloy materials different from conventional Al alloys in that the alloys have high strength and are suited to high-speed forging and high-speed rolling which are performed at comparatively high speeds.

The present inventors have found out that such alloy materials exhibit an excellent effect when they are applied to the heads of golf clubs, and has made the present invention.

This superplastic rapidly solidified Al alloy has a specific strength of not less than 20 $kgf/mm^2/g/cm^3$, a specific Young's modulus of not less than 2,700 $kgf/mm^2/g/cm^3$, and comprises Al crystal grains having a mean grain size of not greater than 1 $\mu$m and intermetallic compounds having a mean particle size of not greater than 1 $\mu$m. Mole preferably, the mean Al crystal grain size is 0.05 to 1 $\mu$m, and the mean intermetallic-compound particle size is 0.001 to 0.1 $\mu$m. It is also preferable that the specific strength be not less than 24 $kgf/mm^2/g/cm^3$ and the specific Young's modulus be not less than 3,000 $kgf/mm^2/g/cm^3$.

Although the golf club head made of a hollow metal for which the present invention is intended to be used comprises a face and a body, the body may also comprise a sole and a crown. The face and the body or the sole and the crown may be integrally joined to form a head. Among these components, at least the face is made of a rapidly solidified Al-based alloy, and the body or the sole and the crown may be made of another Al-based alloy or another kind of alloy. The body or the sole and the crown may also be made of the aforesaid rapidly solidified Al-based alloy.

In accordance with the present invention, since such a rapidly solidified Al-based alloy is used as the material of a golf club head, it is possible to utilize the features of the alloy material, such as high strength, high elasticity and high hardness. In addition, since the rapidly solidified Al-based alloy has a light weight, the golf club head can be produced as a large head. Owing to such a large head, even if a long shaft is used, the target does not become small, so that difficulty which may be caused due to perspective is eliminated. Since a shaft can be made longer, it is possible to increase the moment of inertia required to fly a ball farther. In addition, since the head can be made light in weight, weight distribution to the periphery of the head is enabled and the sweet area can be widened, so that a ball can be stroked stably. In addition, since the rapidly solidified Al-based alloy exhibits superplasticity, a thin wall thickness of 2.0 mm or less can be obtained.

DETAILED DESCRIPTION OF THE PREFERRED EMBODIMENTS

The following is a list of examples of the rapidly solidified Al-based alloys having the compositions expressed by the aforesaid general formulae (I) to (IV), which can be used in the present invention. Of course, the following materials are only exemplifications and there are other materials which can be used in the present invention within the scope of the aforesaid general formulae.

$Al_{78}Ni_{12}Mm_{10}$, $Al_{92}Ni_4Fe_1Mm_3$, $Al_{87}Ni_8Y_5$, $Al_{89.5}Ni_8Zr_{2.5}$, $Al_{89.6}Ni_8Zr_2Mg_{0.5}$, $Al_{90}Ni_7Zr_2Cu_1$, $Al_{91.8}Ni_6Nb_{0.2}Hf_1Ce_1$, $Al_{92.5}Ni_5Fe_1Zr_1Ta_{0.5}$, $Al_{93.5}Ni_2V_1Y_{1.5}Ti_2$, $Al_{87}Co_8Si_1Cu_2Nb_1Zr_1$, $Al_{91}Mn_2Mg_2Zn_1Y_4$, $Al_{87.5}Ni_7Co_1Cr_{0.5}Ca_{0.5}Hf_1Ti_{2.5}$, $Al_{88.7}Ni_8Cr_1Mg_{0.2}Zn_{0.1}Ce_2$

Figure 1:
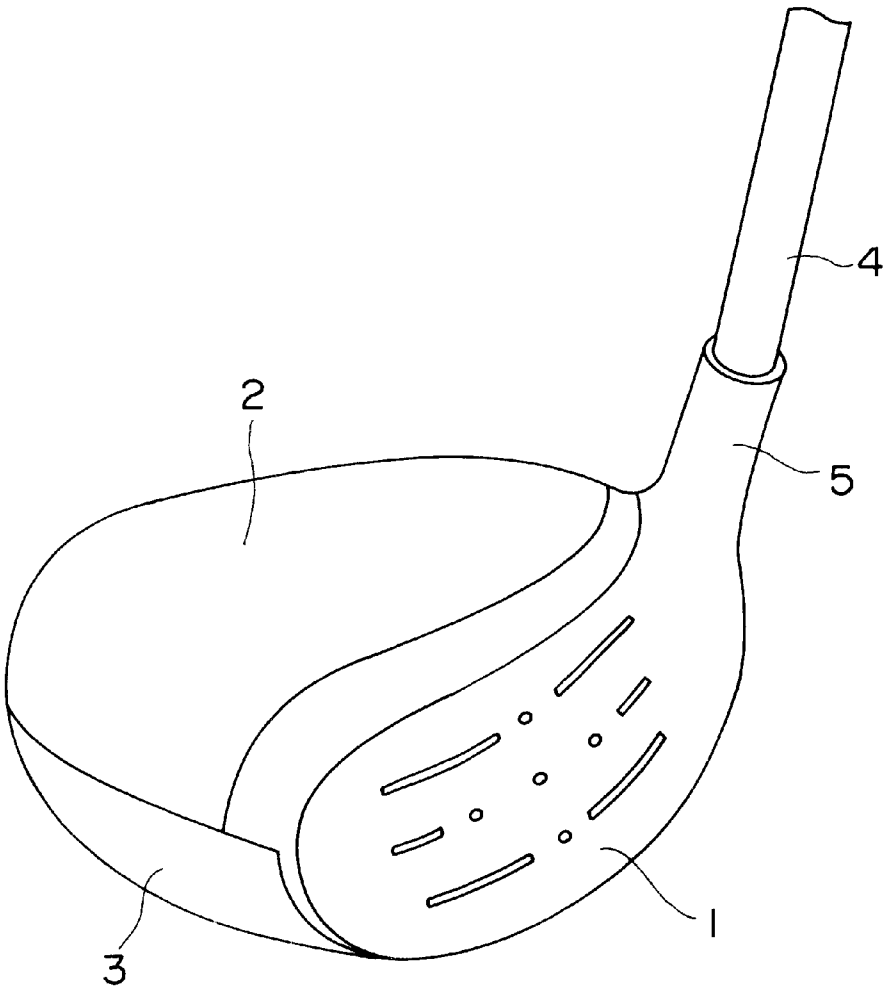
FIG. 1 is a perspective view of the golf club head according to the present invention.

FIG. 1 is a perspective view of a golf club head to which the present invention is applied. Reference numeral 1 denotes a face, reference numeral 2 denotes a crown, reference numeral 3 denotes a sole, reference numeral 4 denotes a shaft, and reference numeral 5 denotes a hosel.

Figure 2:
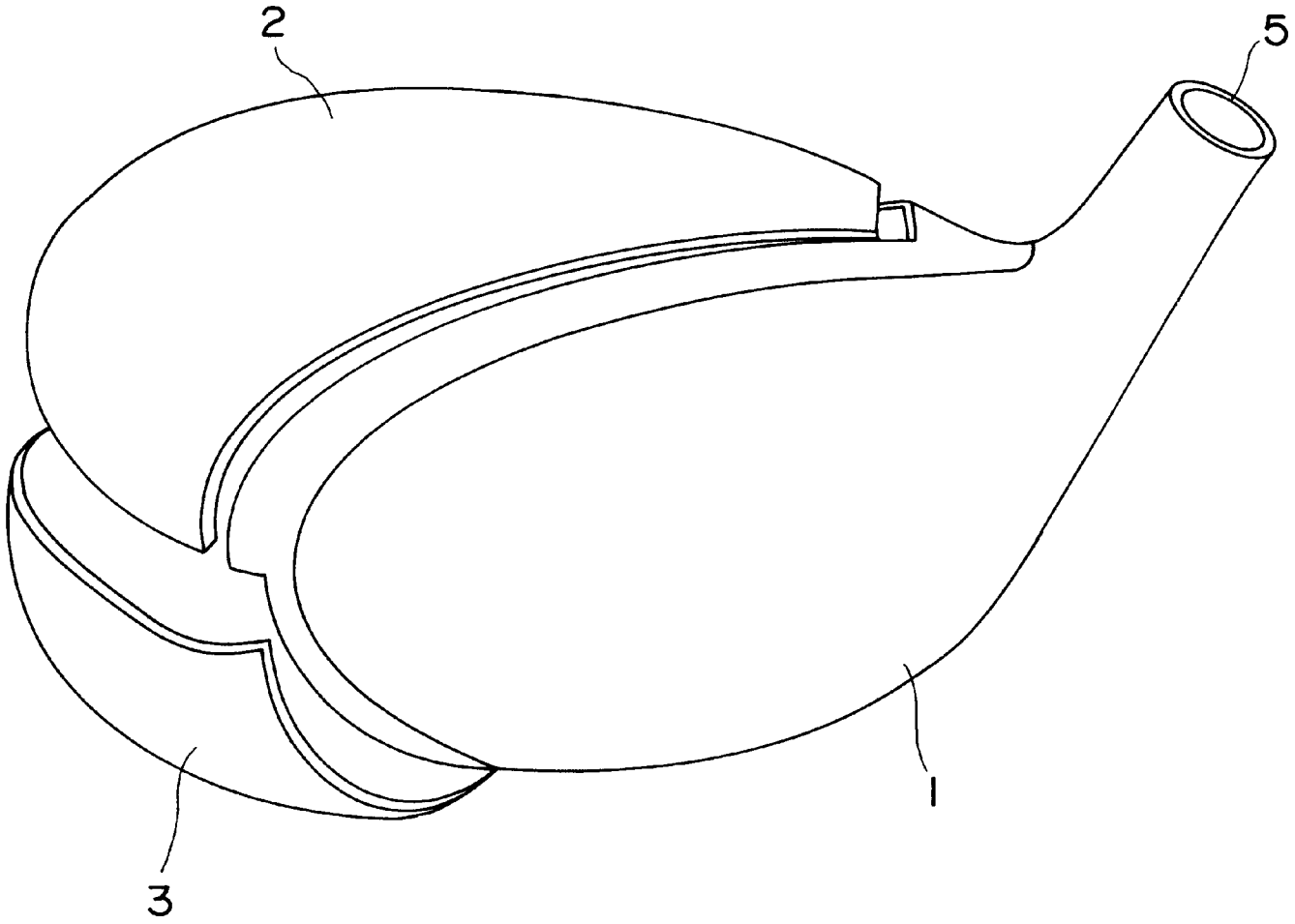
FIG. 2 is an exploded perspective view of each member of one embodiment.

FIG. 2 is a perspective view showing the state before the constituents are joined. The crown 2 and the sole 3 are members separate from each other, and the face 1 and the hosel 5 are integrally formed. The crown 2 and the sole 3 may be integrally formed as a body.

Figure 3:
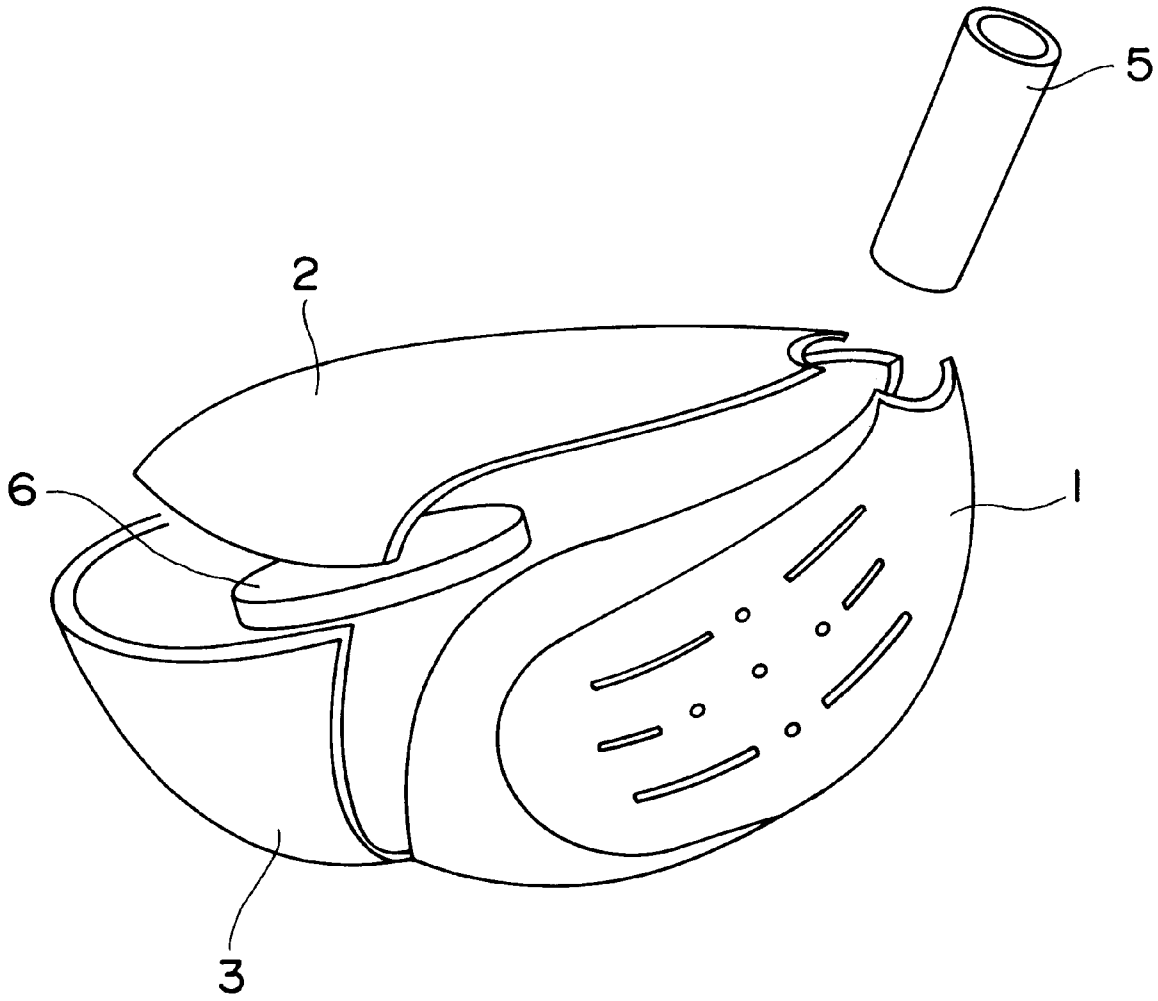
FIG. 3 is an exploded perspective view of each member of another embodiment.

FIG. 3 shows another example of the golf club head, in which the face 1 and the hosel 5 are prepared as separate components. There is also shown an internal balance weight 6.

In the present invention, it is preferred that golf club head have a volume not less than 220 cc and not greater than 320 cc and a weight not less than 170 g and not greater than 220 g.

EXAMPLE

A rapidly solidified Al-based alloy having a composition of $Al_{93}Ni_6Mm_{0.9}Ag_{0.1}$ (at%) was prepared as a material. A face, a sole, a crown, a balance weight and a hosel were separately formed out of the material, and were then welded together to prepare a golf club head. The golf club head had a volume of 240 cc and a weight of 198 g.

The rapidly solidified Al-based alloy used in this example was compared with a Ti-based alloy and an Al-based alloy (7075 alloy) which were conventionally used as materials of golf club heads, in terms of specific strength, specific Young's modulus, specific gravity and hardness. Table 1 shows the results of this comparison.

TABLE 1

| | Material | Specfic strength kgf/mm²/g/cm³ | Specific Young's modulus kgf/mm²/g/cm³ | Specific gravity | Hardness Hv |
|---|---|---|---|---|---|
| Example | Rapidly solidified Al-based alloy | 26.8 | 3280 | 2.9 | 220 |
| Comparative Example 1 | Ti-based alloy | 24.4 | 2440 | 4.5 | 315 |
| Comparative Example 2 | 7075 alloy | 20.7 | 2570 | 2.8 | 155 |

As can be seen from Table 1, the rapidly solidified Al-based alloy used in the present invention is superior to either of the comparative materials in specific strength and specific Young's modulus and is smaller in specific gravity than the Ti-based alloy which has recently become popular, so that a superior golf club can be obtained.

The present invention can provide a golf club head which makes it possible to stroke a ball without elastic deformation of its face and also to fly the ball farther with the initial speed thereof maintained, by using a high-strength and high-elasticity material at least in the face, as a raw material for a golf club. In addition, the head can be made large in size because of the light weight of the material, so that difficulty of correct stroke due to perspective do not occur even if the shaft is long. Since a long shaft can be used, the centrifugal force of the club head, and hence the head speed thereof, at the time of a stroke is increased, so that a longer carry can be realized.

What is claimed is:

1. A hollow metal golf club head comprising a face and a body, said golf club head having a volume not less than 220 cc and not greater than 320 cc and a weight not less than 170 g and not greater than 220 g wherein at least said face comprises a rapidly solidified Al-based alloy exhibiting superplasticity and having a specific strength of not less than 20 Kgf/mm²/g/cm³ and a specific Young's modulus of not less than 2,700 Kgf/mm²/g/cm³, said rapidly solidified Al-based alloy expressed by one of the following general formulae (I) to (IV):

$$Al_aM_{1b}X_e \quad (I)$$

$$Al_aM_{1(b-c)}M_{2c}X_e \quad (II)$$

$$Al_aM_{1(b-d)}M_{3d}X_e \quad (III)$$

$$Al_aM_{1(b-c-d)}M_{2c}M_{3d}X_e \quad (IV)$$

wherein M, represents at least one element selected from the group consisting of Mn, Fe, Co, Ni, and Mo; $M_2$ represents at least one element selected from the group consisting of V, Cr, and W; $M_3$ represents at least one element selected from the group consisting of Li, Ca, Mg, Si, Cu, and Zn; X represents at least one element selected from the group consisting of Nb, Hf, Ta, Y, Zr, Ti, Ag, rare-earth elements and a composite (Mm represents misch metal) of rare-earth elements; and a, b, c, d, and e lie in the following ranges, in atomic percentages: $75 \leqq a \leqq 97$, $0.5 \leqq b \leqq 15$, $0.1 \leqq c \leqq 5$, $0.5 \leqq d \leqq 5$, and $0.5 \leqq e \leqq 10$.

2. A golf club head according to claim 1, wherein said body comprises a sole and a crown which are integrally bonded to said face.

3. A golf club head according to claim 1, wherein said face comprises said rapidly solidified Al-based alloy, and said body or a sole and a crown comprise another Al-based alloy or another kind of alloy.

4. A golf club head according to claim 1, wherein said face and said body or a sole and a crown comprise said rapidly solidified Al-based alloy.

5. A hollow metal golf club head comprising a face and a body, said golf club head having a volume not less than 220 cc and not greater than 320 cc and a weight not less than 170 g and not greater than 220 g, wherein at least said face comprises a rapidly solidified Al-based alloy, said rapidly solidified Al-based alloy exhibiting superplasticity and having a specific strength of not less than 20 Kgf/mm²/g/cm³ and a specific Young's modulus of not less than 2,700 Kgf/mm²/g/cm³, said rapidly solidified Al-based alloy having grains with a mean grain size of not greater than 1 μm and intermetallic compounds having a mean particle size of not greater than 1 μm and further wherein said rapidly solidified Al-based alloy is expressed by one of the following general formulae (I) to (IV):

$$Al_aM_{1b}X_e \quad (I)$$

$$Al_aM_{1(b-c)}M_{2c}X_e \quad (II)$$

$$Al_aM_{1(b-d)}M_{3d}X_e \quad (III)$$

$$Al_aM_{1(b-c-d)}M_{2c}M_{3d}X_e \quad (IV)$$

wherein $M_1$ represents at least one element selected from the group consisting of Mn, Fe, Co, Ni, and Mo; $M_2$ represents at least one element selected from the group consisting of V, Cr, and W; $M_3$ represents at least one element selected from the group consisting of Li, Ca, Mg, Si, Cu, and Zn; X represents at least one element selected from the group consisting of Nb, Hf, Ta, Y, Zr, Ti, Ag, rare-earth elements and a composite (Mm represents misch metal) of rare-earth elements; and a, b, c, d, and e lie in the following ranges, in atomic percentages: $75 \leqq a \leqq 97$, $0.5 \leqq b \leqq 15$, $0.1 \leqq c \leqq 5$, $0.5 \leqq d \leqq 5$, and $0.5 \leqq e \leqq 10$.

6. A golf club head according to claim 5, wherein said body comprises a sole and a crown which are integrally bonded to said face.

7. A golf club head according to claim 5, wherein said face comprises said rapidly solidified Al-based alloy, and said body or a sole and a crown comprise another Al-based alloy or another kind of alloy.

8. A golf club head according to claim 5, wherein said face and said body or a sole and a crown comprise said rapidly solidified Al-based alloy.

* * * * *

UNITED STATES PATENT AND TRADEMARK OFFICE

CERTIFICATE OF CORRECTION

PATENT NO.: 5,967,904

DATED: October 19, 1999

INVENTORS: Yoshitaka NAGAI et al.

It is certified that an error appears in the above-identified patent and that said Letters Patent is hereby corrected as shown below:

Title Page, insert --[73] Assignee: YKK Corporation, Tokyo, Japan --.

Title Page, Item [76], in the Inventors, line 3, after "203-7", insert --,--; and line 5, after "2-11-7", insert --,--.

Claim 1, Column 4, line 10, after "220 g", insert --,--.

Claim 1, Column 4, line 24, "M," should read --$M_1$--.

Signed and Sealed this

Fifth Day of September, 2000

*Attest:*

*Attesting Officer*

Q. TODD DICKINSON

*Director of Patents and Trademarks*